US005845421A

United States Patent [19]

Tanaka

[11] Patent Number: 5,845,421

[45] Date of Patent: Dec. 8, 1998

[54] SNOWBOARD SHOES AND CYCLE SHOES HAVING AN INTERMEDIATE SOLE LAYER

[75] Inventor: Kazuki Tanaka, Sakai, Japan

[73] Assignee: Shimano Inc., Sakai, Japan

[21] Appl. No.: 874,352

[22] Filed: Jun. 13, 1997

[51] Int. Cl.[6] ..... A43B 5/04; A63C 9/02

[52] U.S. Cl. ..... 36/117.3; 36/131; 36/115

[58] Field of Search ..... 36/131, 117.3, 36/115, 30 R, 19.5, 75 R, 76 R, 132, 134

[56] References Cited

U.S. PATENT DOCUMENTS

| | | | |
|---|---|---|---|
| 3,273,263 | 9/1966 | Klima | 36/117.3 |
| 3,512,274 | 5/1970 | McGrath | 36/134 |
| 5,125,173 | 6/1992 | Nagano et al. | 36/131 |
| 5,243,773 | 9/1993 | Robic | 36/117.3 |
| 5,363,526 | 11/1994 | Okajima | 36/142 |
| 5,704,139 | 1/1998 | Okajima | 36/115 |

FOREIGN PATENT DOCUMENTS

| | | | |
|---|---|---|---|
| 553934 | 8/1993 | European Pat. Off. | 36/131 |
| 404327801 | 11/1992 | Japan | 36/131 |

*Primary Examiner*—M. D. Patterson

*Attorney, Agent, or Firm*—Shinjyu An Intellectual Property Firm

[57] ABSTRACT

A sole for a snowboard boot is made of a nylon reinforced fiberglass material. The snowboard boot includes an intermediate layer made of a resin material. between the sole and an upper portion of the shoe. The upper portion of the shoe is made of a leather-like material. A first adhesive adhers the upper to the intermediate layer. A second adhesive adheres the intermediate layer to the sole. The first and second adhesives have differing properties and advantages. For instance, the first adhesive 65 provides good adhesive properties between leather material and resin materials. The second adhesive 70 provides good adhesive properties between nylon reinforced fiberglass materials and resin based materials.

14 Claims, 7 Drawing Sheets

SNOWBOARD SHOES AND CYCLE SHOES HAVING AN INTERMEDIATE SOLE LAYER

BACKGROUND OF THE INVENTION

A. Field of the Invention

The present invention is directed to snowboard boots and cycling shoes and, more particularly, to a snowboard boot of the type which has a fastener affixed to a sole of the boot for fixing the boot to a snowboard and a cylcing shoe having a fastener affixed to a sole of the shoe for fixing the shoe to a bicycle pedal.

B. Description of the Related Art

In recent years, snowboarding has become a very popular sport. Originally, snowboards included straps, clasps and harnesses which surrounded portions of boots worn by a snowboard enthusiast, to fix the boots onto the snowboard securely. There is a big problem with such a configuration. The snowboard is such that both boots (and the feet within them) are fixed to a single surface of the snowboard. Such restraints make it very difficult to manuverure the snowboard when not in motion. Typically, a person snowboarding will fall down occasionally. Getting upright again without removing the boots from the snowboard can be difficult in some situations. Further, simply attaching both boots to the snowboard can be a difficult operation in some circumstances.

A recent innovation in snowboard technology has been the development of mechanisms and corresponding boots which engage one another without the use of straps and harnesses to secure the boots to the surface of the snowboard. Such boots and mechanisms are sold under the name CLICKER™ and include a pair of mechanisms which are rigidly attached to one surface of the snowboard and a pair of specially constructed boots. Each of the mechanisms typically include a front fastener and a rear fastener. The rear fastener is supported on a release mechanism. The boots are constructed with front and rear engagement portions, the front engagement portion being configured to engage the front fastener and the rear engagement portion configured to engage the rear fastener. The release mechanism makes it possible to quickly release the boots from the mechanism and make it possible to quickly secure the boots in the mechanisms and hense quickly secure the boots to the snowboard.

In early snowboards, as described above, the straps, clasps and harnesses held the boot to the snowboard. Therefore, the straps, clasps and harnesses were required to have sufficient strength to hold the boots on to the snowboard. In the newer CLICKER™ configuration, the front and rear engagement portions are formed within the sole portions of the boots. Therefore, there are no straps or the like which engage the boots. The boots themselves must provide sufficient strength to keep the snowboard enthusiast firmly attached to the snowboard so that the enthusiast's responses are properly transmitted through the boots to the snowboard. Recently, there has been concern that the adhesives which fix an upper portion of the boot to the sole portion of the boot may not be sufficient to ensure a long useful life of the boot. Typically, the upper portion of the boot is made of a leather or leather-like material and the sole fo the boot is made of a hardened resin or rubber-like materials. The adhesives used to adhere the upper portion of the boot to the sole of the boot currently provide a desired strength but are not considered to be ideal. For instance, adhesives that bond well to resin or rubber-like materials may not bond well to leather or leather-like materials. Further, adhesives that bond well to leather or leather-like materials may not bond well to resin or rubber-like materials. Therefore, the most suitable adhesives may not be used to their advantage in the above described snowboard shoes.

In recent years, bicyclists, and in particular racing cyclists have improved their riding skills by employing a bicycle pedal which includes a means for engaging a cyclist's footwear. With such a footwear engaging means, the bicyclist may use both a down stroke of the foot to produce forward motion and an upstroke to produce forward motion since the engaging means allows for such increase in power transmission. One footwear engaging means includes a cup-like cage formed on the bicycle pedals into which a bicyclist inserts the toe of each shoe. Another footwear engaging means includes a cleat attached to the sole of a bicycling shoe which engages a corresponding cleat engaging mechanism on a bicycle pedal, such as that disclosed in U.S. Pat. No. 5,125,173 to Nagano et al.

A cycling shoe of the type described in U.S. Pat. No. 5,125,173 must be strong enough to withstand the forces produced by the upstroke of a bicyclist. Such bicycling shoes typically have an upper portion that is made of a leather or leather-like material and a sole made of a hardened resin or rubber-like materials. Like the snowboard boot described above, the adhesives used to adhere the upper portion of the shoe to the sole of the shoe currently provide a desired strength but are not considered to be ideal. Adhesives that bond well to resin or rubber-like materials may not bond well to leather or leather-like materials. Further, adhesives that bond well to leather or leather-like materials may not bond well to resin or rubber-like materials. Therefore, the most suitable adhesives may not be used to their advantage in the above described cycling shoes.

SUMMARY OF THE INVENTION

One object of the present invention is to construct snowboard shoes using adhesives that adhere materials together where the adhesives are best suited for the materials they engage.

In accordance with the present invention, an article of footware includes a sole made of a sole forming material. A sole plate is disposed within an upper portion of the sole, the sole plate being fixed to a fastener, the fastener extending lengthwise in the sole and having fastener portions which extend out of a bottom portion of the sole. An intermediate portion is adhered to the sole and the sole plate. An upper portion is adhered to the intermediate portion. A first adhesive adheres the intermediate portion to the upper portion and a second adhesive adheres the intermediate portion to the sole and the sole plate, the first adhesive being an adhesive that exhibits strong adhesive properties in combination with leather materials and resin-based materials and the second adhesive exhibits strong adhesive properties in combination with resin-based materials and the sole forming material.

Preferably, the first adhesive is a polyurethane based adhesive.

Preferably, the intermediate portion is made of a hardened resin material.

Preferably, the intermediate portion is formed from ethylene vinyl acetate copolymer.

Preferably, the fastener is configured for connection to an attachment mechanism on a snowboard.

Preferably, the sole and the upper portion define a snowboard boot.

Preferably, the sole forming material is a nylon reinforced fiberglass material.

Preferably, the fastener is configured for connection to an attachment mechanism on a pedal of a bicycle.

Preferably, the sole and the upper portion define a cycling shoe.

Preferably, the first adhesive exhibits strong adhesive characteristics bonding between an ethylene vinyl acetate copolymer and leather-like materials.

Preferably, the first adhesive exhibits strong adhesive characteristics bonding between an ethylene vinyl acetate copolymer and textile materials.

Preferably, the upper portion is make from leather-like materials.

Preferably, the upper portion is make from textile materials.

In accordance with another aspect of the present invention, a snowboard boot includes a sole made of a sole forming material and a sole plate disposed within a upper portion of the sole, the sole plate being fixed to a fastener, the fastener extending lengthwise in the sole and having fastener portions which extend out of a bottom portion of the sole, the fastener being configured for connection to an attachment mechanism on a snowboard. An intermediate portion is adhered to the sole and the sole plate. An upper portion is adhered to the intermediate portion. A first adhesive adheres the intermediate portion to the upper portion and a second adhesive adheres the intermediate portion to the sole and the sole plate. The first adhesive is an adhesive that exhibits strong adhesive properties in combination with leather materials and resin-based materials and the second adhesive exhibits strong adhesive properties in combination with resin-based materials and the sole forming material.

Preferably, the intermediate portion is formed from ethylene vinyl acetate copolymer.

Preferably, the sole forming material is a nylon reinforced fiberglass material.

Preferably, the upper portion is make from leather-like materials.

In accordance with yet another aspect of the present invention, a cycling shoe includes a sole made of a sole forming material and a sole plate disposed within a upper portion of the sole, the sole plate being fixed to an attachment means, the attachment means being configured for connection to an attachment portion on a pedal of a bicycle. An intermediate portion is adhered to the sole and the sole plate. An upper portion is adhered to the intermediate portion. A first adhesive adheres the intermediate portion to the upper portion and a second adhesive adheres the intermediate portion to the sole and the sole plate. The first adhesive is an adhesive that exhibits strong adhesive properties in combination with leather materials and resin-based materials and the second adhesive exhibits strong adhesive properties in combination with resin-based materials and the sole forming material.

Preferably, the intermediate portion is formed from ethylene vinyl acetate copolymer.

These and other objects, features, aspects and advantages of the present invention will become more fully apparent from the following detailed description of the present invention when taken in conjunction with the accompanying drawings where like reference numerals denote corresponding parts throughout.

DETAILED DESCRIPTION OF THE EMBODIMENTS

Figure 1:
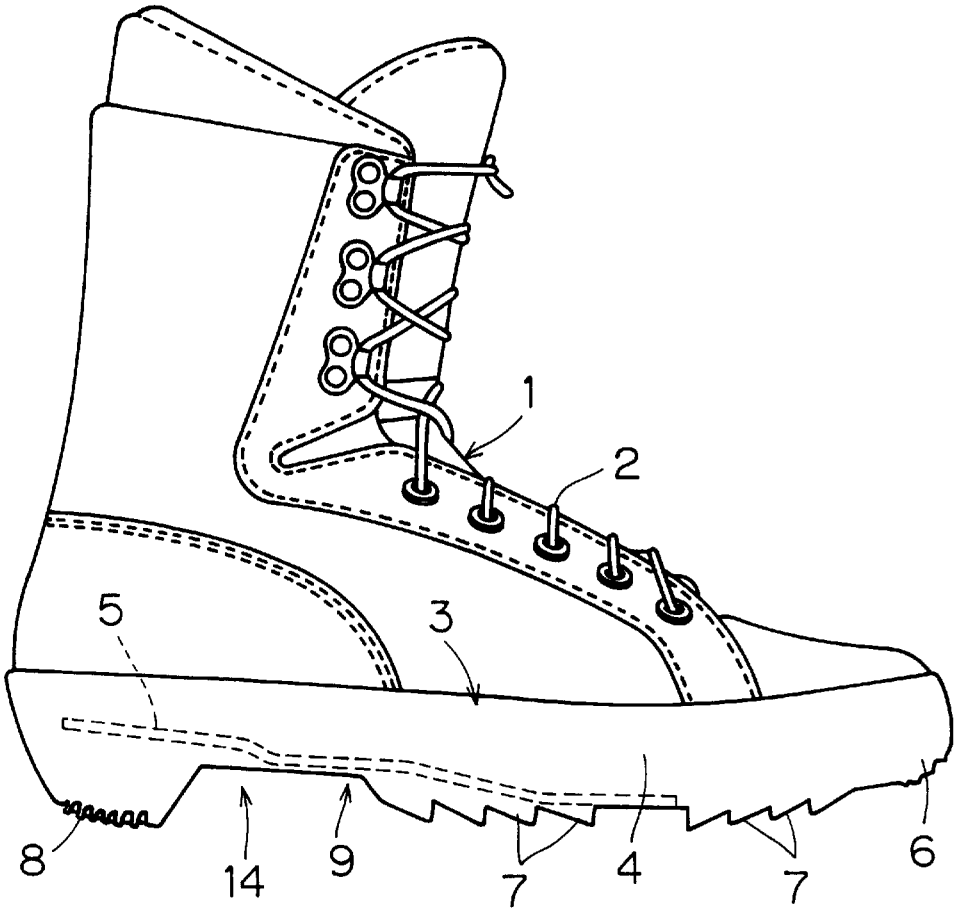
FIG. 1 is a side view of a snowboard boot in accordance with one embodiment of the present invention.
Figure 2:
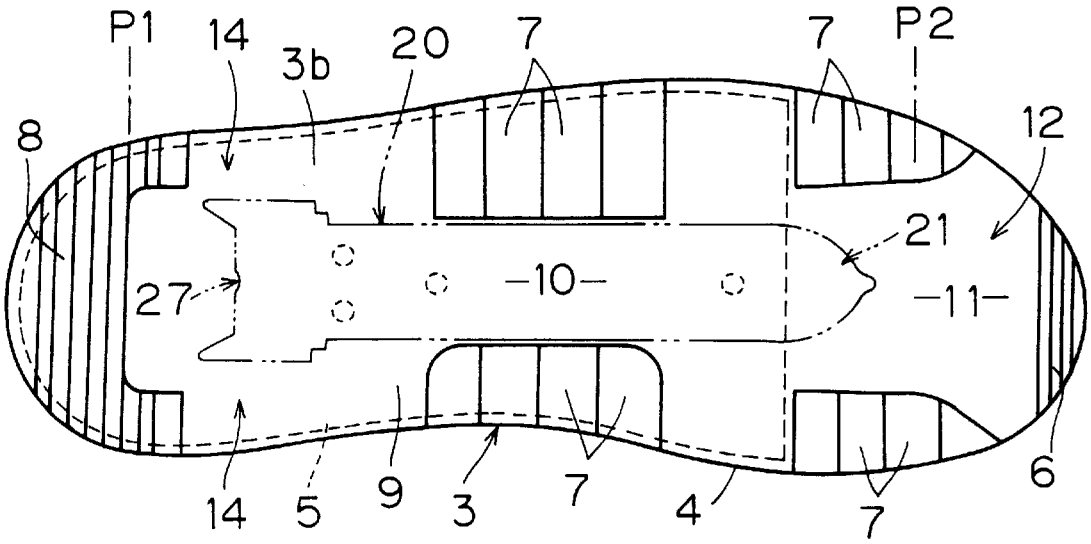
FIG. 2 is a bottom view of the snowboard boot depicted in FIG. 1.

A boot is shown in FIGS. 1 and 2 in accordance with one embodiment of the present invention. The boot includes an upper portion 1 into which a foot may be secured by tightening a shoelace 2. Although only a shoelace 2 is shown, a strap and clasp mechanism may also be employed. The boot also includes a sole 3. The sole 3 includes an elastic outer sole 4 made of rubber, a plate sole 5 made from a generally hard plastic material, a toe 6 which is bent upward, nonskid ridges 7 located between the toe 6 and a non-contact part 9 and formed in the above elastic outer sole 4, and a heel 8 formed in the above elastic outer sole 4. The boot defines a bottom contact surface which contacts the ground when the sole 3 is placed over a flat ground surface. The bottom contact surface includes surfaces of the tips of the above nonskid ridges 7 and the heel 8.

The sole 4 also is provided with a depression 10. The depression 10 is located on this bottom contact surface with a length extending from a point P1 on the sole 3, which is further towards the back of the boot than a non-contact part 9 to a point P2, which is slightly behind the toe 6, thus forming a long depression between the front and back of the boot for attaching a fastener (described below).

Figure 3:
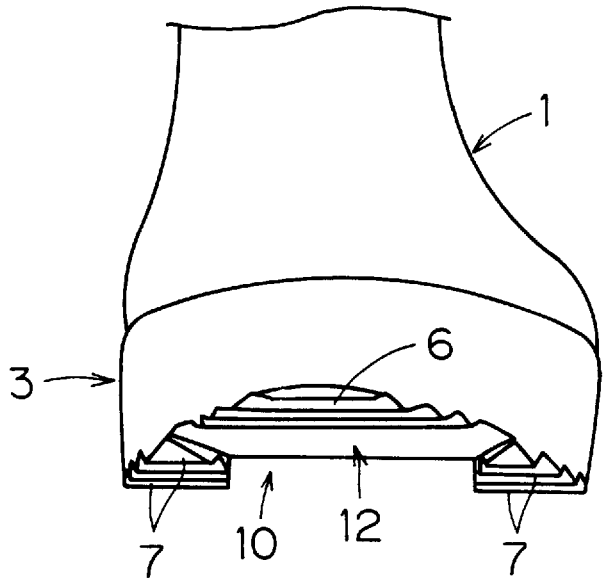
FIG. 3 is a front view of the sole of the snowboard boot depicted in FIG. 1.

The snowboard boot is further formed with a recessed groove 11 which is defined between the depression 10 and the toe 6 as an extension of the depression 10. The lateral sides of the depression 10 and recess 11 contact the ground when the bottom contact surface of sole 3 comes into contact with a flat ground surface. The toe 6 usually does not contact the ground because of its upward-bent design, the result is a space 12 that has a structure that opens frontally to the boot as shown in FIG. 3.

Figure 4:
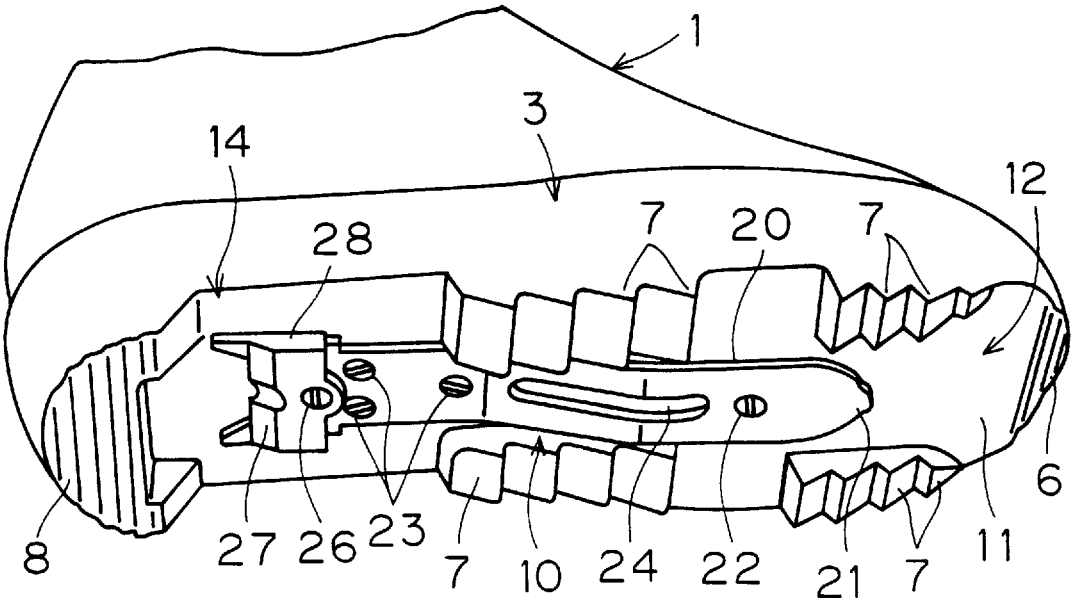
FIG. 4 is an oblique view of the sole of the snowboard boot depicted in FIG. 1, showing a fastener.
Figure 5:
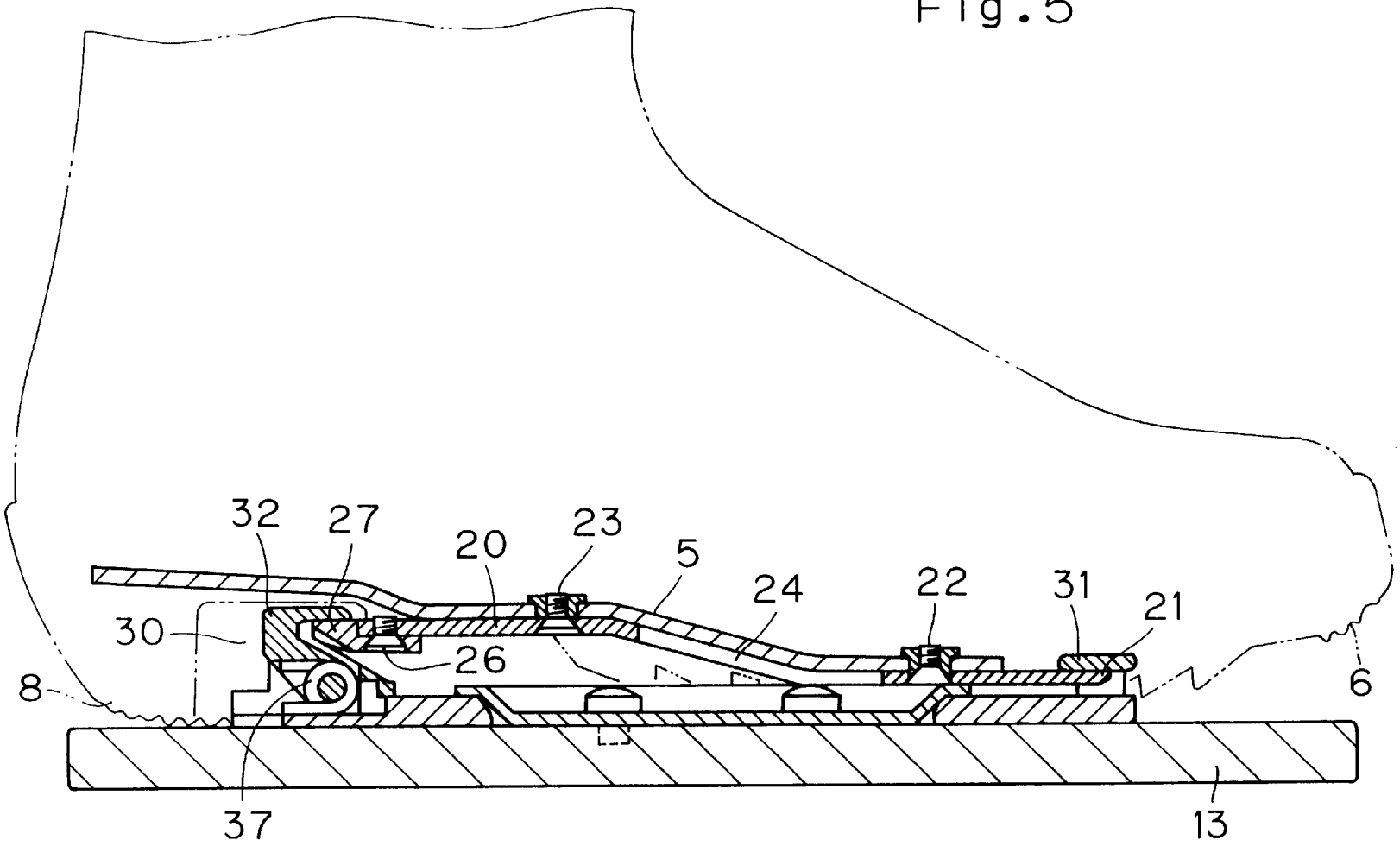
FIG. 5 is a side cross-sectional view of portions of the sole of the snowboard boot depicted in FIGS. 1–4, showing the attachment of the fastener to the snowboard binding.
Figure 6:
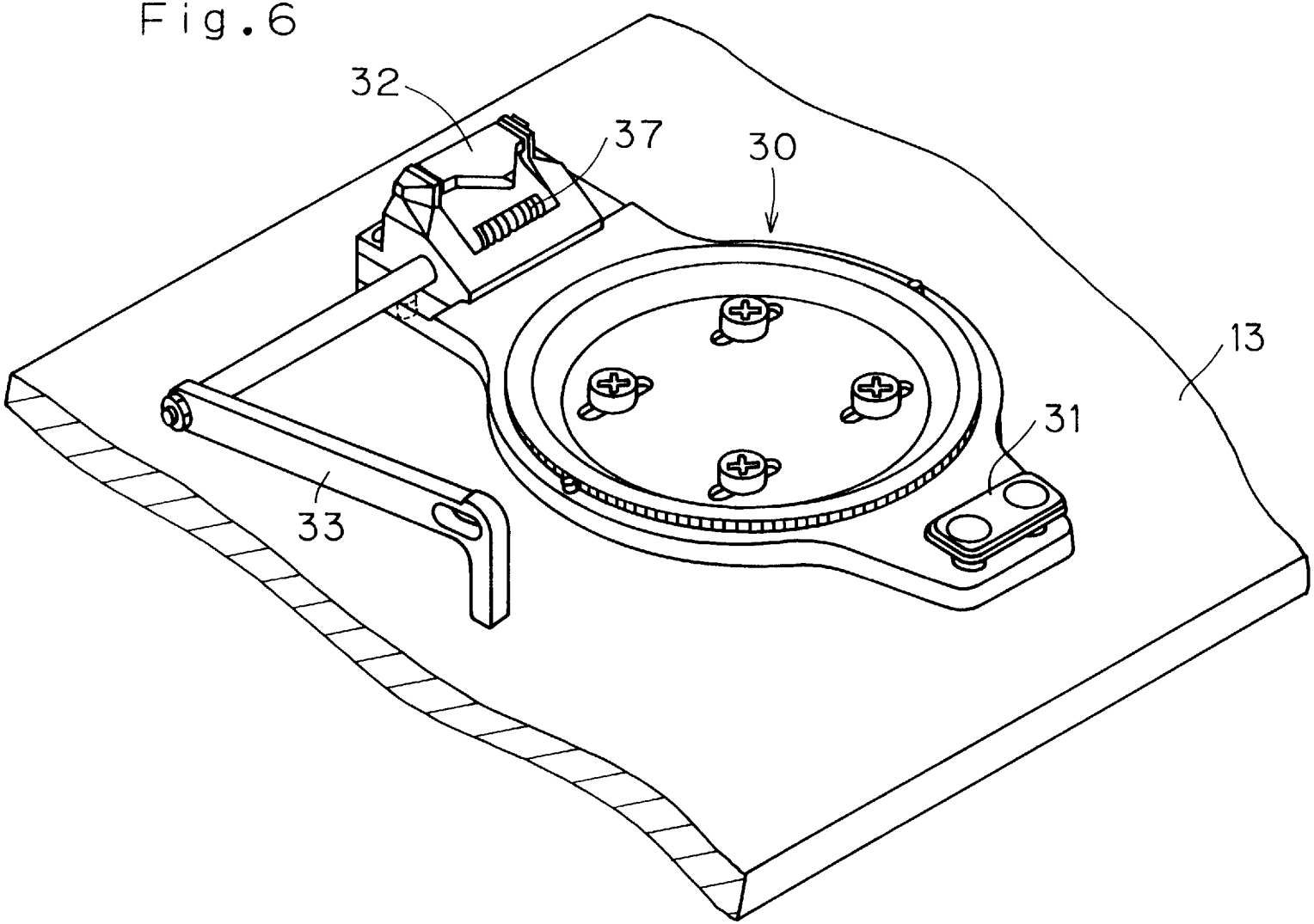
FIG. 6 is an oblique view of a snowboard binding used with the snowboard boot in accordance with the present invention.

The snowboard boot has a fastener 20 attached at the depression 10, as shown in FIG. 4. The snowboard boot attaches to the snowboard 13 via a binding mechanism 30, as shown in FIG. 5. The attachment between the snowboard boot and the snowboard 13 is possible because of the configuration of the fastener 20 and the binding mechanism 30. The snowboard boot can be used for manipulating or steering the snowboard 13 in a manner well know due to the attachment of the snowboard boot to the binding mechanism 30. The binding mechanism 30 is shown in FIG. 6 attached to the snowboard 13. Details of the fastener 20 and the binding mechanism 30 are described in greater detail in co-pending U.S. Pat. application Ser. No. 08/579,648 filed Dec. 27, 1995. The disclosure of co-pending U.S. Pat. application Ser. No. 08/579,648 filed Dec. 27, 1995 is incorporated herein by reference.

The fastener 20 is made from a metal plate material. As shown in FIGS. 4 and 5, the fastener 20 includes a frontal engagement component 21, a rear engagement component 27 and a notch hole 24 located between the front and back ends thereof. The fastener 20 is fixed to the sole 3 via a fastening screws 22, 23 and 26.

The fastener 20 and the depression 10 are configured such that the boot may be fastened to the snowboard 13 by sliding the sole 3 of the boot towards the front of the snowboard binding mechanism 30. A front fastener 31 of the binding mechanism 30 passes through the space 12, recessed groove 11, and engages frontal engagement component 21 of the fastener 20. Thereafter, a rear fastener 32 of the binding mechanism 30 can engage the rear engagement component 27. The rear fastener 32 is mounted for pivotal movement in the binding mechanism 30. A spring 37 biases the rear fastener 32 into engagement with the rear engagement component 27. A lock release lever 33 is connected to the rear fastener 32 may be pivoted to release the rear engagement component 27 from the binding mechanism 30.

Since the sole 3 of the snowboard boot connects to the binding mechanism 30, the upper portions of the snowboard boot must have a high degree of strength and some flexibility to accomodate the movements of a snowboard enthusiast. Therefore, in accordance with the present invention, the snowboard boot is assembled as described below with respect to FIGS. 7 and 9.

Figure 7:
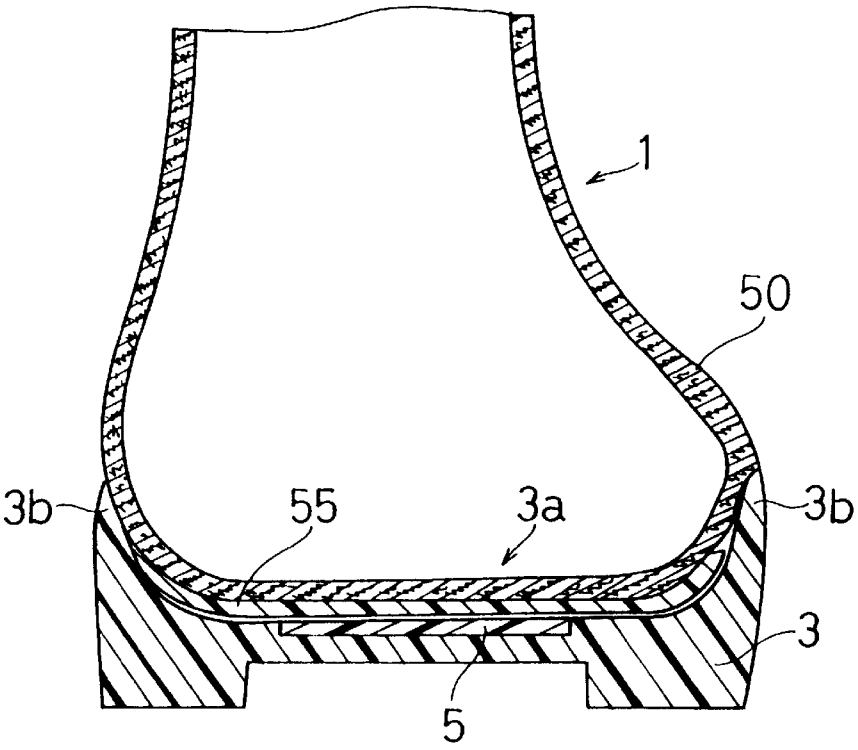
FIG. 7 is a cross-sectional view of a snowboard boot illustrating a method of attaching an upper portion of the boot to the sole.

As shown in FIG. 7, the upper portion 1 of the snowboard boot is formed of a leather material 50. The leather material 50 may be real leather, a synthetic leather-like material, or the like. Preferably, the leather material 50 has some flexibility, but only that required by a snowboard enthusiast. Generally, a snowboard boot should have a relatively rigid upper portion 1. Leather like materials are ideal in that they can be made to be generally rigid with some small amount of flexibility.

The sole 3 is made of a material suitable for forming the sole of a boot. For instance, the sole 3 may preferably be made of a nylon reinforced fiberglass material.

The leather matierial 50 extends into a hollow portion 3*a* of the sole 3, and contacts the upper edges 3*b* of the sole 3. An appropriate adhesive material may be disposed between the upper edges 3*b* and the leather material 50 to adhere one to the other. As mentioned above, the sole 3 includes a sole plate 5. As shown in FIG. 5, the plate sole 5 is used for attaching the fastener 20 to the sole 3, and is constructed in a manner that tightens and fixes the fastener 20 by the force of tightening attachment screws 22 and 23 which extend through the fastener 20. The sole plate 5 is made of a generally rigid plastic, hardened resin or polymer material. The sole plate 5 covers a portion of the inner surface of the hollow portion 3*a* of the sole 3. An intermediate sole member 55 is disposed within the hollow portion 3*a* of the sole 3 covering the sole plate 5 and other portions of the surface of the hollow portion 3*a* of the sole, as is shown in FIG. 7.

The intermediate sole member 55 is made of a hardened resin material and is generally rigid, but is far more flexible than the sole plate 5. The intermediate sole member 55 has different properties that that of the sole 3 in that it must be more flexible. Preferably, the intermediate sole member 55 is made of a polymer material such as ethylene vinyl acetate copolymer or EVA. However other suitable materials may also be used.

Figure 9:
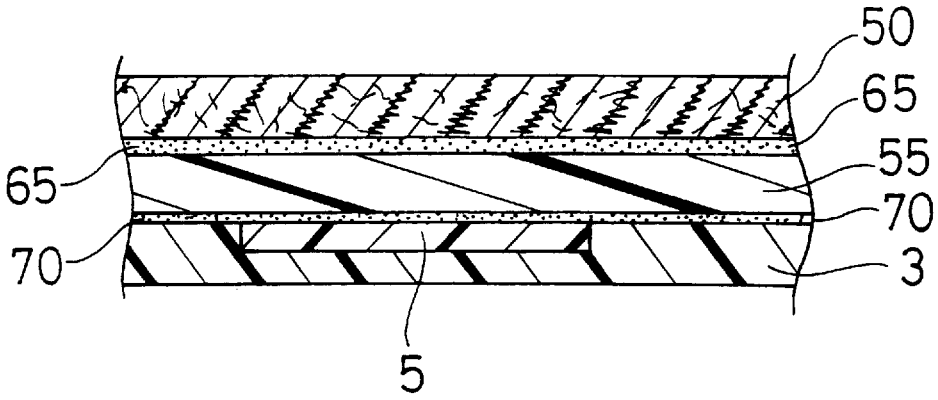
FIG. 9 is a cross-sectional view of a portion of the embodiment of the boot depicted in FIG. 7, showing the attachment of the upper portion of the boot to the sole in greater detail, on a slightly larger scale.

As shown in FIG. 9, a first adhesive 65 is used to bond the leather material 50 to the intermediate sole member 55. A second adhesive 70 is used to bond the intermediate sole member 55 to the sole 3 and the sole plate 5. The first adhesive 65 may be, for instance, BOND ACE 5100A manufactured by DONGSUNG Chemical Co. Ltd., Pusan, South Korea. The first adhesive 65 is a polyurethane based adhesive. Such an adhesive is advantageous because it exhibits good adhesive properties when used with both plastic or resin based materials and leather or leather-like materials. Therefore, the first adhesive 65 provides good adhesive properties between the leather material 50 and the intermediate sole member 55.

The second adhesive 70 may be any of a variety of adhesives that exhibit good adhesive properties between nylon reinforced fiberglass materials and resin based materials. The second adhesive 70 is preferably BOND ACE 8250, also manufactured by DONGSUNG Chemical Co. Ltd., Pusan, South Korea. It should be appreciated that alternate adhesives may be substituted for the second adhesive, providing the adhesive characteristics of the substituted adhesive produce the desired strength described herein.

The intermediate member 55 is such that it may easily be adhered to another material using many different types of adhesives. The adhesives that display good adhesive properties with leather-like materials do not necessarily display good adhesive properties when used with a nylon reinforced fiberglass material. As well, the adhesives that display good adhesive properties with nylon reinforced fiberglass materials do not necessarily display good adhesive properties when used with a leather-like material. However, the intermediate member 55 is such that it permits both types of adhesives described above to exhibit their good adhesive properties.

The intermediate member 55 serves to enhance the structural strength of the snowboard boot of the present invention by enabling the use of adhesives which provide the snowboard boot with a high degree of strength to withstand the forces experienced while the snowboard is attached to the snowboard boots. The intermediate member 55 serves also as a moisture barrier inhibiting the movement of moisture.

Figure 8:
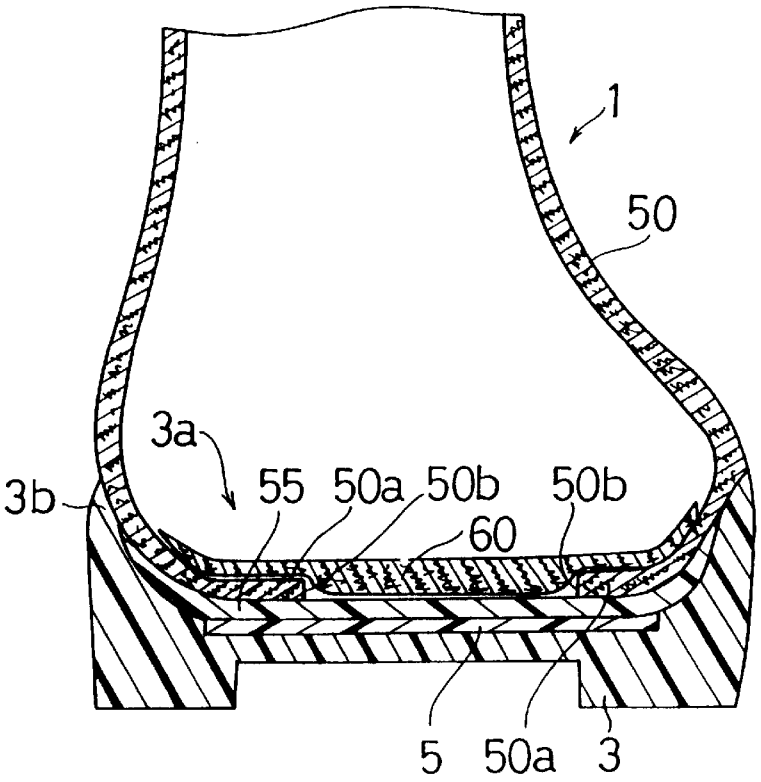
FIG. 8 is a cross-sectional view of a snowboard boot illustrating another method of attaching the upper portion of the boot to the sole.

In an alternate embodiment of the invention shown in FIG. 8, the upper portion 1 of the snowboard boot is made of a leather material 50 having an aperture 50*b* formed at a bottom portion thereof. The leather material 50 has a engagement portion 50*a* which defines the aperture 50*b*. A pad 60 is disposed in the hollow portion 3*a* of the sole 3 covering the engagement portion 50*a* and the exposed portion of the intermediate pad 55. Other than the aperture 50*b*, the alternate embodiment is generally the same as the embodiment depicted in FIG. 7 and in particular, utilizes the first and second adhesives in a manner described above. The pad 60 is provided for comfort rather than as a structural member and therefore any of a variety of adhesives may be used to adher the pad 60 to the engagment portion 50*a* of the leather material 50.

Figure 10:
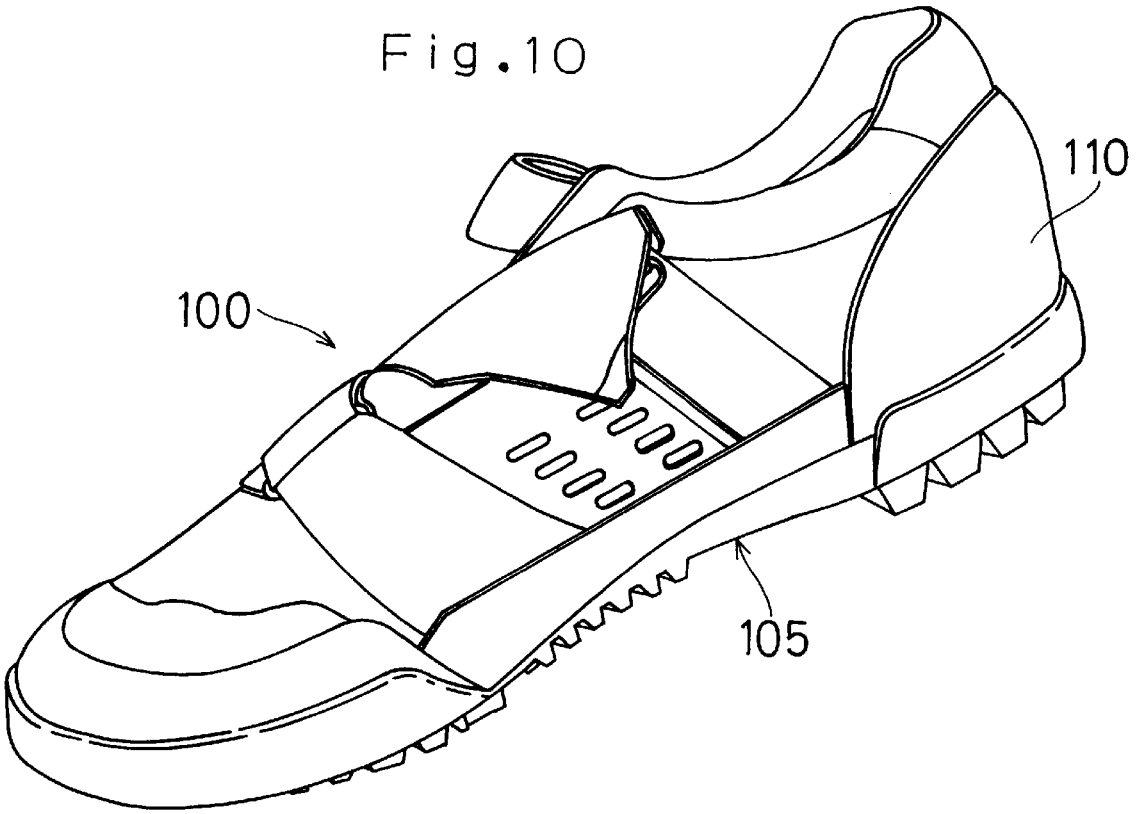
FIG. 10 is an oblique view of a cycling shoe in accordance with the present invention.
Figure 11:
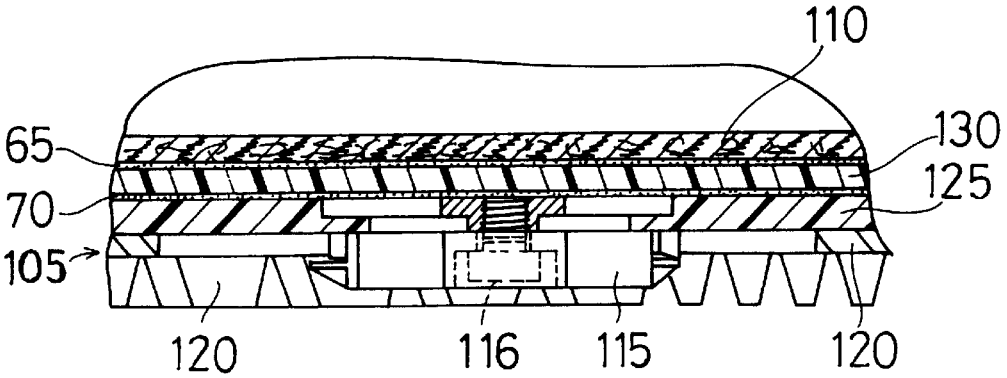
FIG. 11 is a cross-sectional view of a portion of the cycling shoe depicted in FIG. 10, showing the attachment of an upper portion of the shoe to a sole of the shoe, on a slightly larger scale.

In accordance with another embodiment of the present invention, a cycling shoe 100 shown in FIG. 10 is constructed in a manner similar to that described above with respect to the snowboard boot. The cycling shoe 100 may have any of a variety of soles, such as the sole 105. For instance the sole 105 may be of a type described in greater detail in U.S. Pat. No. 5,125,173, to Nagano et al., and commonly assigned to Shimano Inc. U.S. Pat. No. 5,125,173 is incorporated herein by reference.

The cycling shoe 100 includes the sole 105 and an upper 110 which is made of either a leather-like material or a textile material or may be a combination of the two and could be any of variety of natural and synthetic materials. The sole 105 includes a tread portion 120 made of a rubber or rubber-like material, a middle sole 125 made of a hard resin, resin-like material or nylon-fiberglass material and an intermediate sole member 130. The intermediate sole member 130 is similar to the intermediate layer 55 described above with respect to the snowboard boots. In particular, the intermediate sole member 130 is made of a polymer material such as ethylene vinyl acetate copolymer or EVA. However other suitable materials may also be used.

The middle sole 125 supports a cleat 115 that is retained by a bolt 11*b*. The cleat 115 is configured to engage a cleat engaging mechanism (not shown) in a bicycle pedal (not shown), such as that described in detail in U.S. Pat. No. 5,125,173. The middle sole 125 is adhered to the tread portion 120 by a suitable adhesive. The first adhesive 65 is used to bond the upper 110 to the intermediate sole member 130 in a manner similar to that described above with respect to the snowboard boot. The second adhesive 70 is used to bond the intermediate sole member 130 to the middle sole 125. The first adhesive 65 as described above, may be BOND ACE 5100A manufactured by DONGSUNG Chemical Co. Ltd., Pusan, South Korea. BOND ACE 5100A is a polyurethane based adhesive. Such an adhesive is advantageous because it exhibits good adhesive properties when used with both plastic or resin based materials and leather or leather-like materials. Therefore, the first adhesive 65 provides good adhesive properties between the upper 110 and the intermediate sole member 130.

The second adhesive 70, as mentioned above, may be any of a variety of adhesives that exhibit good adhesive properties between materials typically used to form soles of shoes, such as nylon reinforced fiberglass materials and resin based materials. The second adhesive 70 is preferably BOND ACE 8250, also manufactured by DONGSUNG Chemical Co. Ltd., Pusan, South Korea. It should be appreciated that alternate adhesives may be substituted for the second adhesive, providing the adhesive characteristics of the substituted adhesive produce the desired strength described herein.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An article of footware comprising:

a sole made of a sole forming material;

a sole plate disposed within an upper portion of said sole, said sole plate being fixed to a fastener, said fastener extending lengthwise in said sole and having fastener portions which extend out of a bottom portion of said sole;

an intermediate portion adhered to said sole and said sole plate;

an upper portion adhered to said intermediate portion; wherein a first adhesive adheres said intermediate portion to said upper portion and a second adhesive adheres said intermediate portion to said sole and said sole plate, said first adhesive being an adhesive that exhibits strong adhesive properties in combination with leather materials and resin-based materials and said second adhesive exhibits strong adhesive properties in combination with resin-based materials and said sole forming material.

2. The article of footware as set forth in claim 1, wherein said first adhesive is a polyurethane based adhesive.

3. The article of footware as set forth in claim 1, wherein said intermediate portion is made of a hardened resin material.

4. The article of footware as set forth in claim 1, wherein said intermediate portion is formed from ethylene vinyl acetate copolymer.

5. The article of footware as set forth in claim 1, wherein said fastener includes means for connection to an attachment mechanism on a snowboard.

6. The article of footware as set forth in claim 5, wherein said sole and said upper portion at least partially form a snowboard boot.

7. The article of footware as set forth in claim 6, wherein said sole forming material is a nylon reinforced fiberglass material.

8. The article of footware as set forth in claim 1, wherein said fastener includes means for connection to an attachment mechanism on a pedal of a bicycle.

9. The article of footware as set forth in claim 8, wherein said sole and said upper portion at least partially form a cycling shoe.

10. The article of footware as set forth in claim 9, wherein said sole forming material is a rubber material.

11. The article of footware as set forth in claim 1, wherein said first adhesive comprises an adhesive which adheres to an ethylene vinyl acetate copolymer and leather materials.

12. The article of footware as set forth in claim 1, wherein said first adhesive exhibits comprises an adhesive which adheres to an ethylene vinyl acetate copolymer and textile materials.

13. The article of footware as set forth in claim 1, wherein said upper portion is make from any one of a group comprising leather and imitation leather materials.

14. The article of footware as set forth in claim 1, wherein said upper portion is make from textile materials.

* * * * *